US006902856B2

(12) United States Patent
Matsushima et al.

(10) Patent No.: US 6,902,856 B2
(45) **Date of Patent: *Jun. 7, 2005**

(54) TONER, IMAGE FORMING METHOD, AND IMAGE FORMING APPARATUS

(75) Inventors: Asao Matsushima, Hino (JP); Hiroyuki Kozuru, Hino (JP); Meizo Shirose, Hachioji (JP); Hiroshi Yamazaki, Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/315,489

(22) Filed: Dec. 9, 2002

(65) Prior Publication Data

US 2003/0157421 A1 Aug. 21, 2003

(30) Foreign Application Priority Data

Dec. 14, 2001 (JP) ..... 2001-381439

(51) Int. Cl.[7] ..... G03G 13/01

(52) U.S. Cl. ..... 430/45; 430/47; 430/107.1; 430/110.4; 430/124; 430/126

(58) Field of Search ..... 430/45, 47, 107.1, 430/110.4, 124, 126, 108.4

(56) References Cited

U.S. PATENT DOCUMENTS

| | | | | |
|---|---|---|---|---|
| 5,596,393 | A * | 1/1997 | Kobayashi et al. | 399/174 |
| 6,689,522 | B2 * | 2/2004 | Yamazaki et al. | 430/45 |
| 2002/0034703 | A1 * | 3/2002 | Yamazaki et al. | 430/109.1 |

OTHER PUBLICATIONS

Diamond, A.S., Ld. *Handbook of Imaging Materials*, Marcel Dekker, Inc, NY (1991), pp. 163–168, Sections 4.2 & 4.2.1.*

Schaffert, R.M., *Electrophotography*, John Wiley & Sons, NY, (1975), pp. 55–56, Section 2.9.*

* cited by examiner

*Primary Examiner*—Janis L. Dote

(74) *Attorney, Agent, or Firm*—Squire, Sanders & Dempsey

(57) ABSTRACT

An electrophotographic image forming method is disclosed. In the method each of a plurality of toner images formed on the latent image bearing body is sequentially onto an intermediate transfer body, and the transferred image on the intermediate transfer body is transferred to an image forming support, and fixed using a heating roller fixing system, and the toner satisfies ratio (Dv50/Dp50) is from 1.00 to 1.15; ratio (Dv75/Dp75) is from 1.00 to 1.20; and the content ratio of toner having a particle diameter of at most 0.7×(Dp50) is less than or equal to 10 percent by number. Dv50, Dp50, Dv75 and Dp75 are specified in the specification.

15 Claims, 2 Drawing Sheets

TONER, IMAGE FORMING METHOD, AND IMAGE FORMING APPARATUS

FIELD OF THE INVENTION

The present invention relates to a toner and an image forming method, which are employed in the copier and printer field, and in more detail to a toner which is suitably employed in an image forming method using an intermediate transfer body which is employed to form color images, and an image forming method employing the same.

BACKGROUND OF THE INVENTION

Known as an color image forming method is one, employing a so-called intermediate transfer system, in which a latent image formed on an electrostatic latent image bearing body is developed employing toner; instead of transferring the resulting toner image directly onto an image forming support, said toner image is temporarily transferred onto an intermediate transfer body; thereafter, the toner image is re-transferred onto an image forming support; and the toner image, which is transfer formed onto the image forming support, is then fixed.

In the intermediate transfer system, each toner image formed on the latent image bearing body is transferred onto the intermediate transfer body a plurality of times, for example, four times. By such procedure, each of several color toner layers is laminated (each color is superimposed). In such an operation, occasionally as each color toner layer is transferred onto the intermediate transfer body, non-uniform transfer occurs.

On the other hand, widely employed, as a device to fix toner images formed on the image forming support, is a heating roller fixing system utilized in a fixing apparatus provided with a heating roller and a pressure roller. In this system, since toner comes into contact with the surface of the heating roller, toner is subjected to electrostatic repulsive force so as to be occasionally repelled.

SUMMARY OF THE INVENTION

An object of the present invention is to minimize the aforesaid non-uniform transfer and image roughness which tend to occur during image formation of electrostatic latent images of an electrophotographic system, and particularly to minimize non-uniform transfer and image roughness which tend to occur during image formation in which color toners are superimposed on an intermediate transfer body and subsequently, after transferring the superimposed color toner image from the intermediate transfer body to an image support, fixing is carried out employing a heating roller fixing system.

In an image forming method comprising a process which forms a latent image on a latent image bearing body, a process which develops said latent image employing a developer comprising toner, a process which transfers a toner image formed onto said latent image bearing body onto an intermediate transfer body, a process which transfers said toner image formed on said intermediate transfer body to an image forming support, and a process which fixes said toner image which is transferred onto and formed on said image forming support, employing a fixing apparatus using a heating roller fixing system, an image forming method wherein said toner comprises at least colored particles containing a resin and a colorant; ratio (Dv50/Dp50), in which (Dv50) is the 50 percent volume particle diameter of said toner and (Dp50) is the 50 percent number particle diameter, is from 1.00 to 1.15; further, ratio (Dv75/Dp75) in which (Dv75) is the cumulative 75 percent volume particle diameter from the largest particle diameter of said toner and (Dp75) is the cumulative 75 percent number particle diameter, is from 1.00 to 1.20; and still further the content ratio of toner, having a particle diameter of at most 0.7×(Dp50,) is less than or equal to 10 percent by number.

In image forming method comprising the steps of:

forming a first latent image corresponding to a first color image on a latent image bearing body, developing the first latent image employing a developer comprising a first color toner to form a first color toner image on the latent image bearing body, transferring the first color toner image on the latent image bearing body to an intermediate transfer body to form a first color toner image on the intermediate transfer body;

forming a second latent image corresponding to a second color image on the latent image bearing body, developing the second latent image employing a developer comprising a second color toner to form a second color toner image on the latent image bearing body, transferring the second color toner image on the latent image bearing body to the intermediate transfer body having the first color image;

forming a third latent image corresponding to a third color image on the latent image bearing body, developing the third latent image employing a developer comprising a third color toner to form a third color toner image on the latent image bearing body, transferring the third color toner image on the latent image bearing body to the intermediate transfer body to form a third color toner image on the intermediate transfer body having the first and second color images;

forming a fourth latent image corresponding to a fourth color image on the latent image bearing body, developing the fourth latent image employing a developer comprising a fourth color toner to form a fourth color toner image on the latent image bearing body, transferring the fourth color toner image on the latent image bearing body to the intermediate transfer body to form a fourth color toner image on the intermediate transfer body having the first, second and third color images;

transferring the first color, second color, third color and fourth color toner images on the intermediate transfer body to an image forming support; and fixing the toner images formed on the image forming support with a fixing apparatus using a heating roller fixing system, in the image forming method, each of the toners is a first color, second color, third color, or fourth color toner containing at least a resin and a colorant, and ratio (Dv50/Dp50) of each toner, is from 1.00 to 1.15 in which (Dv50) is the 50 percent volume particle diameter and (Dp50) is the 50 percent number particle diameter; ratio (Dv75/Dp75) is from 1.00 to 1.20 wherein (Dv75) is the cumulative 75 percent volume particle diameter from the largest particle diameter of each of the toner and (Dp75) is the cumulative 75 percent number particle diameter of the same; and in addition, the proportion of toner particles having a diameter of at most 0.7×(Dp50) is less than or equal to 10 percent by number.

In an image forming method comprising a process which forms a latent image corresponding to a yellow image on a latent image bearing body, a process which develops said latent image employing a developer comprising a yellow toner, and a process which transfers a toner image formed on said latent image bearing body to an intermediate transfer body; a process which forms a latent image corresponding to a magenta image on a latent image bearing body, a process which develops said latent image employing a developer comprising a magenta toner, and a process which transfers a toner image formed on said latent image bearing body to an intermediate transfer body; a process which forms a latent image corresponding to a cyan image on a latent image bearing body, a process which develops said latent image employing a developer comprising a cyan toner, and a process which transfers a toner image formed on said latent image bearing body to an intermediate transfer body; a process which forms a latent image corresponding to a black image on a latent image bearing body, a process which develops said latent image employing a developer comprising a black toner, and a process which transfers a toner image formed on said latent image bearing body to an intermediate transfer body; a process which transfers each of said color toner images formed on said intermediate transfer body is transferred onto an image forming support; and a process which fixes the toner image transferred onto and formed on said image forming support, employing a fixing apparatus using a heating roller fixing system, each of said toners is a yellow, magenta, cyan, or black toner containing at least a resin and a colorant. Further, ratio (Dv50/Dp50) of each toner, is from 1.00 to 1.15 in which (Dv50) is the 50 percent volume particle diameter and (Dp50) is the 50 percent number particle diameter; ratio (Dv75/Dp75) is from 1.00 to 1.20 wherein (Dv75) is the cumulative 75 percent volume particle diameter from the largest particle diameter of each of said toner and (Dp75) is the cumulative 75 percent number particle diameter of the same; and in addition, the proportion of toner particles having a diameter of at most 0.7×(Dp50) is less than or equal to 10 percent by number.

DETAILED DESCRIPTION OF THE INVENTION

Figure 1:
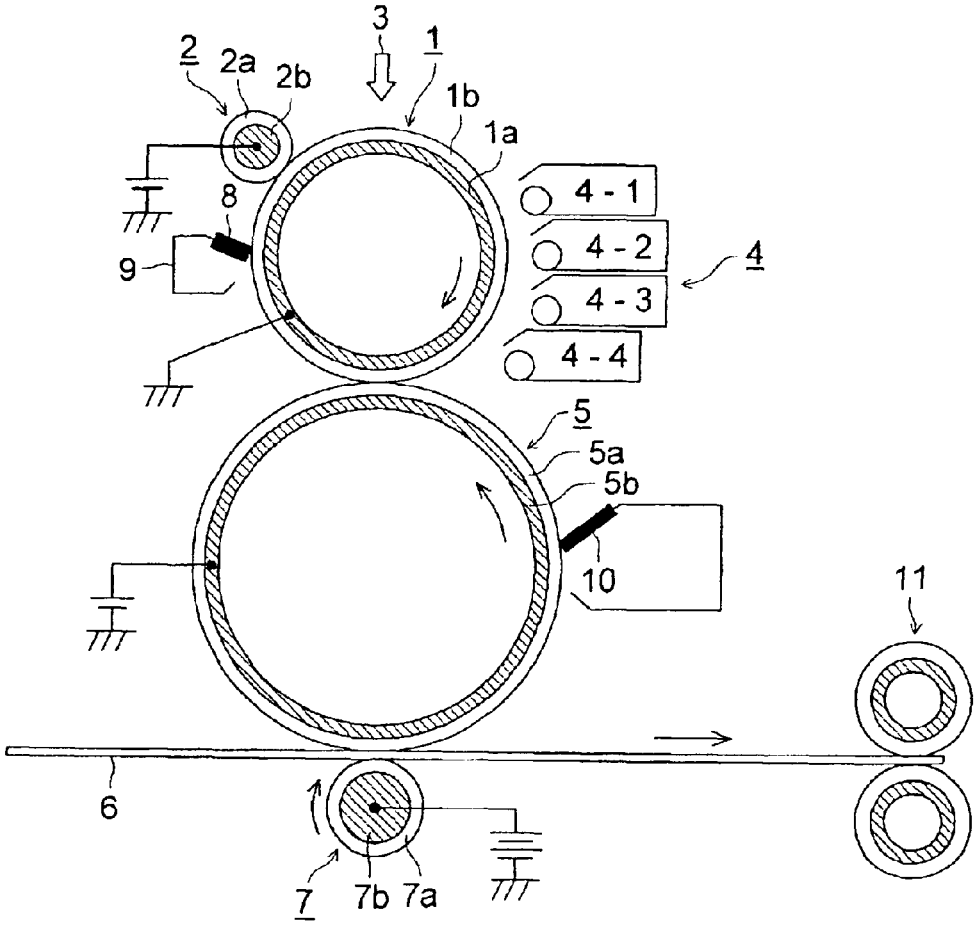
FIG. 1 is a schematic view of an image forming apparatus which may be employed for the invention.

The present invention and preferred embodiments thereof will now be described.

In the particle size distribution of the electrostatic latent image developing toner, the proportion of the component, having a small particle diameter, is not only decreased but also while paying attention to 50 percent particle diameter as a median, the particle diameter at 75 percent frequency obtained by totaling the small diameter component deviated from said particle diameter and those from larger particle diameter is designated as a specified value.

In the present invention, preferable particle size distribution of toner particles is one which is obtained when particles are monodispersed or nearly monodispersed. It is essential that ratio (Dv50/Dp50) is from 1.00 to 1.15, wherein (Dv50) is the 50 percent volume particle diameter and (Dp50) is the 50 percent number particle diameter. The ratio is more preferably from 1.00 to 1.13.

Further, ratio (Dv75/Dp75) is from 1.00 to 1.12, wherein Dv75 is the cumulative 75 percent volume particle diameter from the maximum diameter of the colored particle and Dp75 is the cumulative 75 percent number particle diameter. An increase in weakly charged components, as well as generation of toner having reverse polarity, is minimized, or generation of excessively charged components is minimized. As a result, it is possible to minimize image degradation due to repellency during transfer, as well as during fixing.

Further, the proportion of colored particles, having a particle diameter of at most 0.7×(Dp50), is less than or equal to 10 percent by number. In the same manner as described above, an increase in weakly charged components, as well as generation of toner having reverse polarity, are minimized, or generation of excessively charged components is minimized. As a result, it is possible to minimize image degradation due to repellency during transfer as well as during fixing.

In a plurality of color toners employed in a color image forming method, difference between the maximum 50 percent volume particle diameter and the minimum 50 percent volume particle diameter of a plurality of color toners is preferably less than or equal to 1 $\mu$m. During transfer of toner which is superimposed with each color, when the particle size distribution is similar to each other, transferability becomes similar to each other. As a result, image roughness tends not to occur, and at the same time, occurrence of repellency phenomena during fixing is minimized. In addition, difference between the maximum cumulative 75 percent volume particle diameter from the largest particle of each color toner and the minimum cumulative 75 percent volume particle diameter is preferably less than or equal to 1 $\mu$m.

The 50 percent volume particle diameter (Dv50) is preferably from 2 to 8 $\mu$m, and is more preferably from 3 to 7 $\mu$m. By adjusting said diameter to the above range, it is possible to enhance resolution. By adjusting Dv50/Dp50 and Dv75/Dp75 to the specified values as well as by adjusting Dv50 to such a value, it is possible to increase the proportion of toner particles having a minute particle diameter, even though said toner is containing particles having a relatively small diameter, and it is also possible to provide toner capable of forming consistent quality images over an extended period of time.

The cumulative 75 percent volume particle diameter (Dv75) or the cumulative 75 number particle diameter from the largest particle, as described herein, refers to the volume particle diameter or the number particle diameter at the position of the particle size distribution which shows 75 percent of the cumulative frequency with respect to the sum of the volume or the sum of the number from the largest particle.

It is possible to determine 50 percent volume particle diameter (Dv50), 50 percent number particle diameter (Dp50), cumulative 75 percent volume particle diameter (Dv75), and cumulative 75 percent number particle diameter (Dp75), employing a COULTER COUNTER TYPE TAII or a COULTER MULTISIZER (both are manufactured by Coulter Inc.).

The proportion of colored particles having a diameter of less than or equal to 0.7×(Dp50) is 10 percent by number. It is possible to determine the amount of said minute particle toner, employing an electrophoretic light scattering spectrophotometer ELS-800, manufactured by OTSUKA ELECTRONICS Co., Ltd.

In the technical field in which electrostatic latent images are visualized employing dry system development, as an electrostatic image developing toner employed are those which are prepared by adding external additives to colored particles containing at least colorants and resins. However, as long as specifically there occur no problems, it is generally described that colored particles are not differentiated from the electrostatic latent image developing toner. In the present invention, the particle diameter and particle size distribution of the colored particles result in the same measurement values as the electrostatic latent image developing toner.

The particle diameter of external agents is in an order of nm in terms of the number average primary particle. It is possible to determine the diameter employing an Electrophoretic Light Scattering Spectrophotometer "ELS-800" (manufactured by Otsuka Electronics Co., Ltd.).

The structure as well as the production method of the toner of the present invention will now be described.

<Toner>

In the present invention, it is preferable that a coalesced type toner is employed, which is prepared by salting out and fusing resinous particles comprising release agents and colorant particles.

As the reason for such toner, it is assumed that since it is possible to easily control the particle size distribution of the coalesced type toner and it is possible to prepare toner particles which exhibit uniform surface properties of each particle, the effects of the present invention are exhibited without degrading transferability.

The "salting-out/fusion", as described above, refers to simultaneous occurrence of salting-out (aggregation of particles) and fusion (disappearance of the boundary surface among particles) or an operation to render salting-out and fusion to occur simultaneously. In order to render salting-out and fusion to occur simultaneously, it is necessary to aggregate particles (resinous particles and colorant particles) at temperatures higher than or equal to the glass transition temperature (Tg) of resins constituting the resinous particles.

Releasing Agent

The preferable releasing agent employed invention is exemplified.

$$R^1—(OCO—R^2)_n$$

In the formula n is an integer from 1 to 4, preferably from 2 to 4, and more preferably 3 or 4.

Specific Ester Compound $R^1$ and $R^2$ each represents a hydrocarbon group, which may have a substituent.

The number of carbon atoms in $R^1$ is from 1 to 40, preferably from 1 to 20, and more preferably from 2 to 5.

The number of carbon atoms in $R^2$ is from 1 to 40, preferably from 16 to 30, and more preferably from 18 to 26.

In the formula (1) n is an integer from 1 to 4, preferably from 2 to 4, more preferably 3 or 4 and particularly 4.

The specific ester compound is synthesized by a dehydration condensation reaction of an alcohol compound and a carbonic acid adequately.

Most preferable example of the ester compound is pentaerthritoltetrabehanate.

Representative examples are listed as compounds 1 to 26.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

-continued

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6)

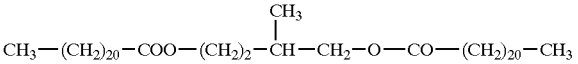

7)

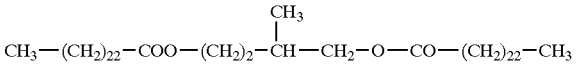

8)

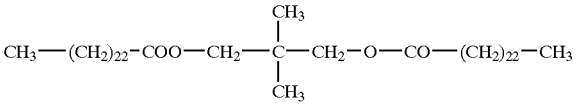

9)

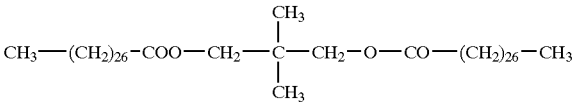

10)

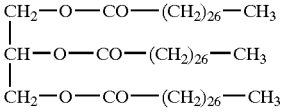

11)

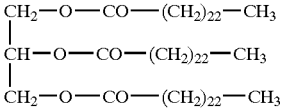

12)

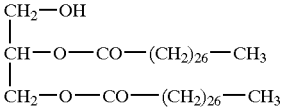

13)

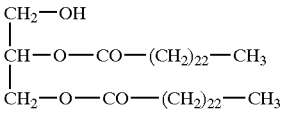

14)

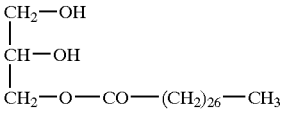

15)

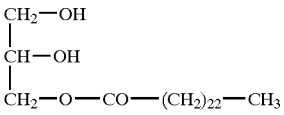

16)

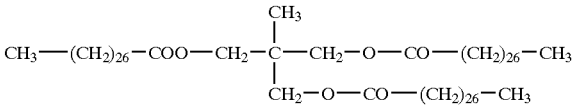

17)

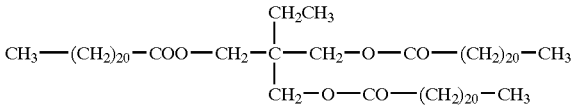

-continued

18)

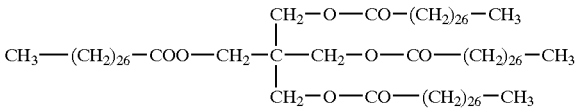

19)

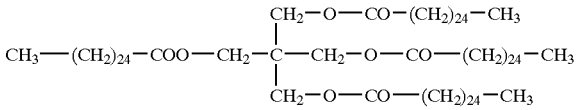

20)

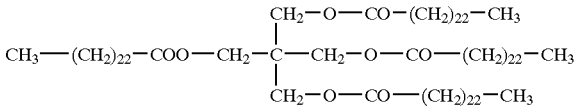

21)

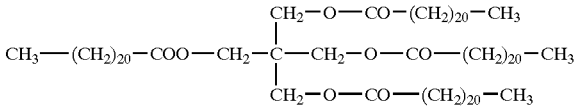

22)

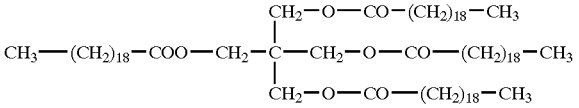

23)

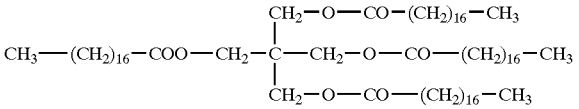

24)

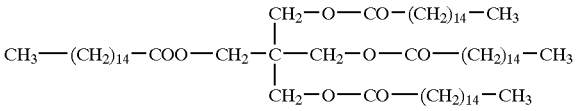

25)

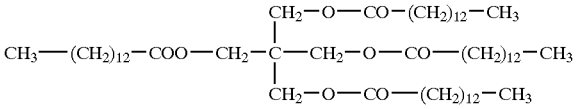

26)

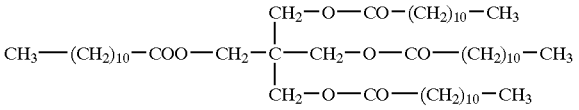

Content of the Releasing Agent

The content ratio of the releasing agent in the toner is commonly from 1 to 30 percent by weight, is preferably from 2 to 22 percent by weight, and is particularly preferably from 1 to 15 percent by weight.

<Resinous Particles Comprising Releasing Agents>

The "resinous particles containing releasing agents", as described in the present invention, may be obtained as latex particles by dissolving releasing agents in monomers to obtain binding resins, and then dispersing the resulting monomer solution into water based medium, and subsequently polymerizing the resulting dispersion.

The weight average particle diameter of said resinous particles is preferably 50 to 2,000 nm.

Listed as polymerization method employed to obtain resinous particles, in which binding resins comprise releasing agents, may be granulation polymerization methods such as an emulsion polymerization method, a suspension polymerization method, a seed polymerization method, and the like.

The following method (hereinafter referred to as an "mini-emulsion method") may be cited as a preferable polymerization method to obtain resinous particles comprising releasing agents. A monomer solution, which is prepared by dissolving releasing agents in monomers, is dispersed into a water based medium prepared by dissolving surface active agents in water at a concentration of less than the critical micelle concentration so as to form oil droplets in water, while utilizing mechanical force. Subsequently, water-soluble polymerization initiators are added to the resulting dispersion and the resulting mixture undergoes radical polymerization. Further, instead of adding said water-soluble polymerization initiators, or along with said water-soluble polymerization initiators, oil-soluble polymerization initiators may be added to said monomer solution.

Herein, homogenizers which result in oil droplets in water dispersion, utilizing mechanical force, are not particularly limited, and may include CLEARMIX (produced by M Tech Co., Ltd.) provided with a high speed rotor, ultrasonic homogenizers, mechanical homogenizers, Manton-Gaulin homogenizers, pressure type homogenizers, and the like. Further, the diameter of dispersed particles is generally 10 to 1,000 nm, and is preferably 30 to 300 nm.

<Binding Resins>

Binding resins, which constitute the toner of the present invention, preferably comprise high molecular weight components having a peak, or a shoulder, in the region of 100,000 to 1,000,000, as well as low molecular weight components having a peak, or a shoulder, in the region of 1,000 to 20,000 in terms of the molecular weight distribution determined by GPC.

Herein, the method for measuring the molecular weight of resins, employing GPC, is as follows. Added to 1 ml of THF is a measured sample in an amount of 0.5 to 5.0 mg (specifically, 1 mg), and is sufficiently dissolved at room temperature while stirring employing a magnetic stirrer and the like. Subsequently, after filtering the resulting solution employing a membrane filter having a pore size of 0.45 to 0.50 $\mu$m, the filtrate is injected in a GPC.

Measurement conditions of GPC are described below. A column is stabilized at 40° C., and THF is flowed at a rate of 1 cc per minute. Then measurement is carried out by injecting approximately 100 $\mu$l of said sample at a concentration of 1 mg/ml. It is preferable that commercially available polystyrene gel columns are combined and used. For example, it is possible to cite combinations of SHODEX GPC KF-801, 802, 803, 804, 805, 806, and 807, produced by Showa Denko Co., combinations of TSKGEL G1000H, G2000H, G3000H, G4000H, G5000H, G6000H, G7000H, TSK GUARD COLUMN, and the like. Further, as a detector, a refractive index detector (IR detector) or a UV detector is preferably employed. When the molecular weight of samples is measured, the molecular weight distribution of said sample is calculated employing a calibration curve which is prepared employing monodispersed polystyrene as standard particles. Approximately ten polystyrenes samples are preferably employed for determining said calibration curve.

The composition materials of resinous particles and the preparation thereof will now be described.

(Monomers)

Of polymerizable monomers which are employed to prepare resinous particles, radical polymerizable monomers are essential components, and if desired, crosslinking agents may be employed. Further, at least one of said radical polymerizable monomers having an acidic group or radical polymerizable monomers having a basic group, described below, is preferably incorporated.

(1) Radical Polymerizable Monomers

Radical polymerizable monomers are not particularly limited. It is possible to employ conventional radical polymerizable monomers known in the art. Further, they may be employed in combination of two or more types so as to satisfy desired properties. Specifically, employed may be aromatic vinyl monomers, acrylic acid ester based monomers, methacrylic acid ester based monomers, vinyl ester based monomers, vinyl ether based monomers, monoolefin based monomers, diolefin based monomers, halogenated olefin monomers, and the like.

Listed as aromatic vinyl monomers, for example, are styrene based monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrne, p-n-nonylstyrene, p-n-decylstyrene, p-n-dodecylstyrene, 2,4-dimethylstyrne, 3,4-dichlorostyrene, and the like.

Listed as acrylic acid ester bases monomers and methacrylic acid ester monomers are methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethyl aminoethyl methacrylate, diethyl aminoethyl methacrylate, and the like.

Listed as vinyl ester based monomers are vinyl acetate, vinyl propionate, vinyl benzoate, and the like.

Listed as vinyl ether based monomers are vinyl methyl ether, vinyl ethyl ether, vinyl isobutyl ether, vinyl phenyl ether, and the like.

Listed as monoolefin based monomers are ethylene, propylene, isobutylene, 1-butene, 1-pentene, 4-methyl-1-pentene, and the like.

Listed as diolefin based monomers are butadiene, isoprene, chloroprene, and the like.

Listed as halogenated olefin based monomers are vinyl chloride, vinylidene chloride, vinyl bromide, and the like.

(2) Crosslinking Agents

In order to improve the desired properties of toner, added as crosslinking agents may be radical polymerizable crosslinking agents. Listed as radical polymerizable agents are those having at least two unsaturated bonds such as divinylbenzene, divinylnaphthalene, divinyl ether, diethylene glycol methacrylate, ethylene glycol dimethacrylate, polyethylene glycol dimethacrylate, phthalic acid diallyl, and the like.

(3) Radical Polymerizable Monomers Having an Acidic Group or a Basic Group

Employed as radical polymerizable monomers having an acidic group or a basic group may, for example, be amine based compounds such as monomers having a carboxyl group, monomers having a sulfonic acid group, and amine based compounds such as primary, secondary, and tertiary amines, quaternary ammonium salts, and the like.

Listed as radical polymerizable monomers having an acidic group are acrylic acid, methacrylic acid, fumaric acid, maleic acid, itaconic acid, cinnamic acid, monobutyl maleate, monooctyl maleate, and the like as monomers having a carboxyl group.

Listed as monomers having sulfonic acid are styrenesulfonic acid, allylsulfosuccinic acid, octyl allylsulfosuccinate, and the like.

These may be in the form of salts of alkali metals such as sodium or potassium, or salts of alkali earth metals such as calcium and the like.

Listed as radical polymerizable monomers having a basic group are amine based compounds which include dimethyl aminoethyl acrylate, dimethyl aminoethyl methacrylate, diethyl aminoethyl acrylate, diethyl aminoethyl methacrylate, and quaternary ammonium salts of said four compounds; 3-dimethylaminophenyl acrylate, 2-hydroxy-3-methacryloxypropyltrimethylammonium salt; acrylamide, N-butylacrylamide, N,N-dibutylacrylamide, piperidylacrylamide, methacrylamide, N-butylmethacrylamide, N-octadecylacrylamide; vinylpyridine; vinylpyrrolidone; vinyl N-methylpyridinium chloride, vinyl N-ethylpyridinium chloride, N,N-diallylmethylammonium chloride, N,N-diallylethylammonium chloride; and the like.

The content ratio of radical polymerizable monomers having an acidic group or a basic group is preferably 0.1 to 15 percent by weight with respect to the total monomers. The content ratio of radical polymerizable crosslinking agents is preferably 0.1 to 10 percent by weight with respect to the total radical polymerizable monomers.

(Chain Transfer Agents)

For the purpose of regulating the molecular weight of resinous particles, it is possible to employ commonly used chain transfer agents.

Said chain transfer agents are not particularly limited, and for example, employed are mercaptans such as octylmercaptan, dodecylmercaptan, tert-dodecylmercaptan, and the like, carbon tetrabromide, styrene dimer, and the like.

(Polymerization Initiators)

Radical polymerization initiators may be suitably employed in the present invention, as long as they are water-soluble. For example, listed are persulfate salts (potassium persulfate, ammonium persulfate, and the like), azo based compounds (4,4'-azobis-4-cyanovaleric acid and salts thereof, 2,2'-azobis(2-amidinopropane) salts, and the like), peroxides, and the like.

Further, if desired, it is possible to employ said radical polymerization initiators as redox based initiators by combining them with reducing agents. By employing said redox based initiators, it is possible to increase polymerization activity and decrease polymerization temperature so that a decrease in polymerization time is expected.

It is possible to select any polymerization temperature, as long as it is higher than the lowest radical formation temperature of said polymerization initiator. For example, the temperature range of 50 to 90° C. is employed. However, by employing a combination of polymerization initiators such as hydrogen peroxide-reducing agent (ascorbic acid and the like), which is capable of initiating the polymerization at room temperature, it is possible to carry out polymerization at at least room temperature.

(Surface Active Agents)

In order to perform polymerization employing the aforementioned radical polymerizable monomers, it is required to conduct oil droplet dispersion in a water based medium employing surface active agents. Surface active agents, which are employed for said dispersion, are not particularly limited, and it is possible to cite ionic surface active agents described below as suitable ones.

Listed as ionic surface active agents are sulfonic acid salts (sodium dodecylbenzenesulfonate, sodium aryl alkyl polyethersulfonate, sodium 3,3-disulfondiphenylurea-4,4-diazo-bis-amino-8-naphthol-6-sulfonate, sodium orthocaroxybenzene-azo-dimethylaniline-2,2,5,5-tetramethyl-triphenylmethane-4,4-diazi-bis-β-naphthol-6-sulfonate, and the like), sulfuric acid ester salts (sodium dodecylsulfonate, sodium tetradecylsulfonate, sodium pentadecylsulfonate, sodium octylsulfonate, and the like), fatty acid salts (sodium oleate, sodium laureate, sodium caprate, sodium caprylate, sodium caproate, potassium stearate, calcium oleate, and the like).

Further, nonionic surface active agents may be employed. Specifically, it is possible to cite polyethylene oxide, polypropylene oxide, a combination of polypropylene oxide and polyethylene oxide, alkylphenol polyethylene oxide, esters of polyethylene glycol with higher fatty acids, esters of polypropylene oxide with higher fatty acids, sorbitan esters, and the like.

<Colorants>

Listed as colorants which constitute the toner of the present invention may be inorganic pigments, organic pigments, and dyes.

Employed as said inorganic pigments may be those conventionally known in the art. Specific inorganic pigments are listed below.

Employed as black pigments are, for example, carbon black such as furnace black, channel black, acetylene black, thermal black, lamp black, and the like, and in addition, magnetic powders such as magnetite, ferrite, and the like.

If desired, these inorganic pigments may be employed individually or in combination of a plurality of these. Further, the added amount of said pigments is commonly between 2 and 20 percent by weight with respect to the polymer, and is preferably between 3 and 15 percent by weight.

When employed as a magnetic toner, it is possible to add said magnetite. In that case, from the viewpoint of providing specified magnetic properties, said magnetite is incorporated into said toner preferably in an amount of 20 to 60 percent by weight.

The organic pigments and dyes may be employed. Specific organic pigments as well as dyes are exemplified below.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment Yellow 155, C.I. Pigment Yellow 156, C.I. Pigment yellow 180, C.I. Pigment Yellow 185, and the like.

Listed as pigments for green or cyan are C.I. Pigment Blue 15, C.I. Pigment Blue 15:2, C.I. Pigment Blue 15:3, C.I. Pigment Blue 16, C.I. Pigment Blue 60, C.I. Pigment Green 7, and the like.

Employed as dyes may be C.I. Solvent Red 1, 59, 52, 58, 63, 111, 122; C.I. Solvent Yellow 19, 44, 77, 79, 81, 82, 93, 98, 103, 104, 112, 162; C.I. Solvent Blue 25, 36, 60, 70, 93, and 95; and the like. Further these may be employed in combination.

These organic pigments, as well as dyes, may be employed individually or in combination of selected ones, if desired. Further, the added amount of pigments is commonly between 2 and 20 percent by weight, and is preferably between 3 and 15 percent by weight.

The colorants may also be employed while subjected to surface modification. As said surface modifying agents may be those conventionally known in the art, and specifically, preferably employed may be silane coupling agents, titanium coupling agents, aluminum coupling agents, and the like.

<External Additives>

For the purpose of improving fluidity as well as chargeability, and of enhancing cleaning properties, the toner of the present invention may be employed into which so-called external additives are incorporated. Said external additives are not particularly limited, and various types of fine inorganic particles, fine organic particles, and lubricants may be employed.

Employed as fine inorganic particles may be those conventionally known in the art. Specifically, it is possible to preferably employ fine silica, titanium, and alumina particles and the like. These fine inorganic particles are preferably hydrophobic. Specifically listed as fine silica particles, for example, are commercially available R-805, R-976, R-974, R-972, R-812, and R-809, produced by Nippon Aerosil Co.; HVK-2150 and H-200, produced by Hoechst Co.; commercially available TS-720, TS-530, TS-610, H-5, and MS-5, produced by Cabot Corp; and the like.

Listed as fine titanium particles, for example, are commercially available T-805 and T-604, produced by Nippon Aerosil Co.; commercially available MT-100S, MT-100B, MT-500BS, MT-600, MT-600SS, and KA-1, produced by Teika Co.; commercially available TA-300SI, TA-500, TAF-130, TAF-510, and TAF-510T, produced by Fuji Titan Co.; commercially available IT-S, IT-OA, IT-OB, and IT-OC, produced by Idemitsu Kosan Co.; and the like.

Listed as fine alumina particles, for example, are commercially available RFY-C and C-604, produced by Nippon Aerosil Co., commercially available TTO-55, produced by Ishihara Sangyo Co., and the like.

Further, employed as fine organic particles are fine spherical organic particles having a number average primary particle diameter of 10 to 2,000 nm. Employed as such particles may be homopolymers or copolymers of styrene or methyl methacrylate.

Listed as lubricants, for example, are metal salts of higher fatty acids, such as salts of stearic acid with zinc, aluminum, copper, magnesium, calcium, and the like; salts of oleic acid with zinc, manganese, iron, copper, magnesium, and the like; salts of palmitic acid with zinc, copper, magnesium, calcium, and the like; salts of linoleic acid with zinc, calcium, and the like; and salts of ricinolic acid with zinc, calcium, and the like.

The added amount of these external agents is preferably 0.1 to 5 percent by weight with respect to the toner.

The toner of the present invention is a coalesced type toner obtained by salting out/fusing resinous particles comprising releasing agents and colorant particles in a water based medium. By salting out/fusing said resinous particles comprising releasing agents, as described above, a toner is obtained in which said releasing agents are finely depressed.

In addition, the toner of the present invention possesses an uneven surface from the production stage, and a coalesced type toner is obtained by fusing resinous particles and colorant particles. Therefore, differences in the shape as well as surface properties among toner particles are minimal. As a result, the surface properties tend to be uniform. Thus difference in fixability among toner particles tends to be minimized so that it is possible to maintain excellent fixability.

<Toner Production Process>

One example of the method for producing the toner of the present invention is as follows:ps (1) a dissolution process in which releasing agents are dissolved in monomers and a monomer solution is prepared
(2) a dispersion process in which the resulting monomer solution is dispersed into a water based medium
(3) a polymerization process in which the resulting water based dispersion of said monomer solution undergoes polymerization so that dispersion (latex) of resinous particles comprising said releasing agents is prepared
(4) a salting-out/fusion process in which the resulting resinous particles and said colorant particles are subjected to salting-out/fusion in a water based medium so as to obtain coalesced particles (toner particles)
(5) a filtration and washing process in which the resulting coalesced particles are collected from the water based medium employing filtration, and surface active agents and the like are removed from said coalesced particles.
(6) a drying process in which washed coalesced particles are dried, and
(7) an external addition process may be included in which external agents are added to the dried coalesced particles.

(Dissolution Process)

Methods for dissolving releasing agents in monomers are not particularly limited.

The dissolved amount of said releasing agents in said monomers is determined as follows: the content ratio of releasing agents is generally 1 to 30 percent by weight with respect of the finished toner, is preferably 2 to 20 percent by weight, and is more preferably 3 to 15 percent by weight.

Further, oil-soluble polymerization initiators as well as other oil-soluble components may be incorporated into said monomer solution.

(Dispersion Process)

Methods for dispersing said monomer solution into a water based medium are not particularly limited. However, methods are preferred in which dispersion is carried out employing mechanical force. Said monomer solution is preferably subjected to oil droplet dispersion (essentially an embodiment in a mini-emulsion method), employing mechanical force, especially into a water based medium prepared by dissolving a surface active agent at a concentration of lower than its critical micelle concentration.

Herein, homogenizers to conduct oil droplet dispersion, employing mechanical forces, are not particularly limited, and include, for example, "CLEARMIX", ultrasonic homogenizers, mechanical homogenizers, and Manton-Gaulin homogenizers and pressure type homogenizers. Further, the diameter of dispersed particles is 10 to 1,000 nm, and is preferably 30 to 300 nm.

(Polymerization Process)

In the polymerization process, polymerization methods (granulation polymerization methods such as an emulsion polymerization method, a suspension polymerization method, and a seed polymerization method) may be employed.

Listed as one example of the preferred polymerization method may be a mini-emulsion method, namely in which radical polymerization is carried out by adding water-soluble polymerization initiators to a dispersion obtained by oil droplet dispersing a monomer solution, employing mechanical force, into a water based medium prepared by dissolving a surface active agent at a concentration lower than its critical micelle concentration.

(Salting-Out/Fusion Process)

In the salting-out/fusion process, a colorant particle dispersion is added to a dispersion containing resinous particles obtained by said polymerization process so that said resinous particles and said colorant particles are subjected to salting-out/fusion in a water based medium.

Further, in said salting-out/fusion process, resinous particles as well as colorant particles may be fused with internal agent particles and the like.

"Water based medium", as described in said salting-out/fusion process, refers to one in which water is a main component (at least 50 percent by weight). Herein, components other than water may include water-soluble organic solvents. Listed as examples are methanol, ethanol, isopropanol, butanol, acetone, methyl ethyl ketone, tetrahydrofuran, and the like. Of these, preferred are alcohol based organic solvents such as methanol, ethanol, isopropanol, butanol, and the like which do not dissolve resins.

It is possible to prepare colorant particles employed in said salting-out/fusion process by dispersing colorants into a water based medium. Dispersion of colorants is carried out in such a state that the concentration of surface active agents in water is adjusted to at least critical micelle concentration.

Homogenizers to disperse colorants are not particularly limited, and preferably listed are CLEARMIX, ultrasonic homogenizers, mechanical homogenizers, Manton-Gaulin and pressure type homogenizers, and medium type homogenizers such as sand grinders, Getman mill, diamond fine mills and the like. Further, listed as surface active agents may be the same as those previously described.

Further, colorants (particles) may be subjected to surface modification. The surface modification method is as follows. Colorants are dispersed into a solvent, and surface modifiers are added to the resulting dispersion. Subsequently the resulting mixture is heated so as to undergo reaction. After completing said reaction, colorants are collected by filtration and repeatedly washed with the same solvent. Subsequently, the washed colorants are dried to obtain the colorants (pigments) which are treated with said surface modifiers.

The salting-out/fusion process is accomplished as follows. Salting-out agents, containing alkaline metal salts and/or alkaline earth metal salts and the like, are added to water comprising resinous particles as well as colorant particles as the coagulant at a concentration of higher than critical aggregation concentration. Subsequently, the resulting aggregation is heated above the glass transition point of said resinous particles so that fusion is carried out while simultaneously conducting salting-out. During this process, organic solvents, which are infinitely soluble in water, may be added.

Herein, listed as alkali metals and alkali earth metals, employed as salting-out agents, are, as alkali metals, lithium, potassium, sodium, and the like, and as alkali earth metals, magnesium, calcium, strontium, barium, and the like. Further, listed as those forming salts are chlorides, bromides, iodides, carbonates, sulfates, and the like.

Further, listed as said organic solvents, which are infinitely soluble in water, are alcohols such as methanol, ethanol, 1-propanol, 2-propanol, ethylene glycol, glycerin, acetone, and the like. Of these, preferred are methanol, ethanol, 1-propanol, and 2-propanol which are alcohols having not more than 3 carbon atoms.

In the salting-out/fusion process, it is preferable that hold-over time after the addition of salting-out agents is as short as possible. Namely it is preferable that after the addition of salting-out agents, dispersion containing resinous particles and colorant particles is heated as soon as possible and heated to a temperature higher than the glass transition point of said resinous particles.

The reason for this is not well understood. However, problems occur in which the aggregation state of particles varies depending on the hold-over time after salting out so that the particle diameter distribution becomes unstable and surface properties of fused toner particles fluctuate.

Time before initiating heating (hold-over time) is commonly not more than 30 minutes, and is preferably not more than 10 minutes.

Temperatures, at which salting-out agents are added, are not particularly limited, and are preferably no higher than the glass transition temperature of resinous particles.

Further, it is required that in the salting-out/fusion process, the temperature is quickly increased by heating. The rate of temperature increase is preferably no less than 1° C./minute. The maximum rate of temperature increase is not particularly limited. However, from the viewpoint of minimizing the formation of coarse grains due to rapid salting-out/fusion, said rate is preferably not more than 15° C./minute.

Further, after the dispersion containing resinous particles and colorant particles is heated to a higher temperature than said glass transition point, it is important to continue the salting-out/fusion by maintaining the temperature of said dispersion for a specified period of time. By so doing, it is possible to effectively proceed with the growth of toner particles (aggregation of resinous particles as well as colorant particles) and fusion (disappearance of the interface between particles. As a result, it is possible to enhance the durability of the finally obtained toner.

Further, after terminating the growth of coalesced particles, fusion by heating may be continued.

(Filtration and Washing)

In said filtration and washing process, carried out is filtration in which toner particles are collected from the toner particle dispersion obtained by the process previously described, and adhered materials such as surface active agents, salting-out agents, and the like, are removed from the collected toner particles (a caked aggregation).

Herein, the filtration methods are not particularly limited, and include a centrifugal separation method, a vacuum filtration method which is carried out employing glass filter and the like, a filtration method which is carried out employing a filter press, and the like.

(Drying Process)

The washed toner particles are dried in this process.

Listed as dryers employed in this process may be spray dryers, vacuum freeze dryers, vacuum dryers, and the like. Further, standing tray dryers, movable tray dryers, fluidized-bed layer dryers, rotary dryers, stirring dryers, and the like are preferably employed.

It is proposed that the moisture content of dried toners is preferably not more than 5 percent by weight, and is more preferably not more than 2 percent by weight.

Further, when dried toner particles are aggregated due to weak attractive forces among particles, aggregates may be subjected to pulverization treatment. Herein, employed as pulverization devices may be mechanical pulverization devices such as a jet mill, a HENSCHEL mixer, a coffee mill, a food processor, and the like (Addition Process of External Additives)

This process is one in which external additives are added to dried toner particles.

Listed as devices which are employed for the addition of external additives, may be various types of mixing devices known in the art, such as tubular mixers, HENSCHEL mixers, NAUTER mixers, V-type mixers, and the like.

The proportion of number of toner particles having a diameter of at most 0.7×(Dp50) Proportion of is 10 percent or less. It is preferable to control the temperature during the salting-out/fusion narrow for obtaining toner particles satisfying such condition. More in concrete temperature is elevated as fast as possible. The time for elevation is preferably 30 minutes or less, more preferably 10 minutes or less, and the elevation rate is preferably 1 to 15° C./minutes.

Besides colorants and releasing agents, materials, which provide various functions as toner materials may be incorporated into the toner of the present invention. Specifically, charge control agents are cited. Said agents may be added employing various methods such as one in which during the salting-out/fusion stage, said charge control agents are simultaneously added to resinous particles as well as colorant particles so as to be incorporated into the toner, another is one in which said charge control agents are added to resinous particles, and the like.

In the same manner, it is possible to employ various charge control agents, which can be dispersed in water. Specifically listed are nigrosine based dyes, metal salts of naphthenic acid or higher fatty acids, alkoxyamines, quaternary ammonium salts, azo based metal complexes, salicylic acid metal salts or metal complexes thereof.

<Developers>

The toner of the present invention may be employed in either a single-component developer or a two-component developer.

Listed as single-component developers are a non-magnetic single-component developer, and a magnetic single-component developer in which magnetic particles having a diameter of 0.1 to 0.5 μm are incorporated into a toner. Said toner may be employed in both developers.

Further, said toner is blended with a carrier and employed as a two-component developer. In this case, employed as magnetic particles of the carrier may be conventional materials known in the art, such as metals such as iron, ferrite, magnetite, and the like, alloys of said metals with aluminum, lead and the like. Specifically, ferrite particles are preferred. The volume average particle diameter of said magnetic particles is preferably 15 to 100 μm, and is more preferably 25 to 80 μm.

The volume average particle diameter of said carrier can be generally determined employing a laser diffraction type particle size distribution measurement apparatus HELOS, produced by Sympatec Co., which is provided with a wet type homogenizer.

The preferred carrier is one in which magnetic particles are further coated with resins, or a so-called resin dispersion type carrier in which magnetic particles are dispersed into resins. Resin compositions for coating are not particularly limited. For example, employed are olefin based resins, styrene based resins, styrene-acryl based resins, silicone based resins, ester based resins, or fluorine containing polymer based resins. Further, resins, which constitute said resin dispersion type carrier, are not particularly limited, and resins known in the art may be employed. For example, listed may be styrene-acryl based resins polyester resins, fluorine based resins, phenol resins, and the like.

Image Forming Method and Image Forming Apparatus

In the apparatus shown in FIG. 1, a developer 4 comprises a developer containing a cyan toner, a developer containing a magenta toner, a developer containing a yellow toner and a developer containing a black toner, which are each charged in the developing devices 4-1, 4-2, 4-3 and 4-4, respectively.

The static latent images formed on a photoreceptor 1 are developed by a magnetic brush method or a nonmagnetic single-component developing method to form toner images of each of the colors. The latent image is formed by exposing light 3 on the latent image carrier 1 corresponding to digital image information though, for example, a polygon mirror.

The photoreceptor 1, composed of a substrate 1*a*, and a photosensitive layer 1*b* formed on the substrate, is a photoreceptor drum or a photoreceptor belt having a layer of a photoconductive insulation substance. The photoreceptor 1 is rotated in the direction of the arrow in the drawing by a driving member not shown in the drawing.

A photoreceptor having an amorphous silicone layer or an organic photosensitive layer is preferably used for the photoreceptor 1.

The organic photosensitive layer may be either a single layer type containing a charge generation substance and a charge transport substance in the same layer or a function separation layer type composed of a charge transport layer and a charge generation layer. A multiple layer type photosensitive layer having a structure in which a charge generating layer and a charge transport layer are provided on an electroconductive substrate in this order is an example of preferable photosensitive layer.

A polycarbonate resin, a polyester resin and an acryl resin are particularly preferable in the transferring and cleaning ability and the unsatisfied cleaning, adhesion of the toner to the photoreceptor and the filming of an exterior additive are difficultly occurred.

In the charging process relating to the image forming method of the invention, either a non-contacting method using a corona discharging device in which the charging device is not contacted to the photoreceptor 1 or a contacting method using a roller may be used. The contacting method shown in FIG. 1 is preferably used for uniformly charging, simplification of the apparatus and inhibiting of ozone generation.

The charging roller 2 is basically composed of a metal shaft 2*b* at the central portion and an electroconductive elastic layer 2*a* constituting the circumference of the roller. The charging roller 2 is contacted to the surface of the photoreceptor 1 with a pressure and rotated accompanied with the rotation of the photoreceptor.

The following conditions are preferred when the charging roller is used. The pressure applied for contacting the roller is from 4.9 to 490 N/m (5 to 500 g/cm), an alternative current voltage of from 0.5 to 5 kVpp with a frequency of from 50 Hz to 5 kHz and a direct current voltage of from ±0.2 to ±1.5 kV when the direct current voltage is overlapped with the alternative current voltage, and a direct current voltage of from ±0.2 to ±5 kV when the direct current is applied.

A charging method using a charging blade or that using an electroconductive brush may be used other than the above-mentioned method. Such the contact charging means have merits that no high voltage is necessary and the generation of ozone is inhibited.

An electroconductive rubber is preferred for the material of the charging roller and the charging blade as the charging means. A mold-releasing layer may be provided on the surface of such the charging means. As the mold-releasing layer, a nylon resin, PVDF (vinylidene polyfluoride) and PVDC (vinylidene polychloride) are usable.

The toner image formed on the photoreceptor is transferred onto the intermediate transfer member 5 to which a voltage, for instance from ±0.1 to ±5 kV is applied.

Toner particles remaining on the surface of the photoreceptor 1 is recovered into a toner box 9 by means of a cleaning device 8.

The intermediate transfer member 5 is composed of a pipe-shaped electroconductive metal central shaft 5*b* and a medium resistive elastic layer 5*a* formed at the circumference of the shaft. The metal central shaft may be a plastic pipe on which an electroconductive plating layer is provided.

The elastic layer having a medium electroresistivity is a solid or porous layer composed of a elastic substance such as silicone rubber, chloroprene rubber, urethane rubber, EPDM (ternary copolymer of ethylene-propylene-diene) in which a substance for giving an electro conductivity such as carbon black, zinc oxide, tin oxide and silicon carbide is dispersed so as to control the electroresistivity (volume resistivity) to a medium resistively of from $10^5$ to $10^{11}$ Ω·cm.

The intermediate transfer member 5 is held in parallel with the photoreceptor in the direction of the shaft thereof so as to contact to the lower portion of the photoreceptor surface. The intermediate transfer member 5 is counter-clockwise rotated as shown by the arrow at a circumference speed the same as that of the photoreceptor 1.

The first color toner image formed and carried on the photoreceptor 1 is intermediately transferred onto the surface of the intermediate transfer member 5 at the time of passing through the nipping zone at which the photoreceptor 1 and the intermediate transfer member 5 are contacted to each other by the electric field generated at the nipping zone by the transfer bias applied to the intermediate transfer member 5.

The surface of the intermediate transfer member 5 is cleaned after transfer of the image to the image forming support by a releasable cleaning means 10, according to necessity. The cleaning means 10 is released from the intermediate transfer member surface when the toner image is existed on the intermediate transfer member 5 so as not to disarrange the toner image.

A transfer means is arranged in parallel with the intermediate transfer member 5 in the direction of the shaft thereof so as to contact to the lower portion of the intermediate transfer member 5. The transfer member is, for instance, a transfer roller 7 which is clockwise rotated at a circumference speed the same as that of the intermediate transfer member 5 as shown by the arrow in the drawing. The transfer roller 7 may be either arranged so as to directly contact to the intermediate transfer member 5 or to contact a belt between the intermediate transfer member 5 and the transfer roller 7.

The transfer roller 7 is basically composed of a central metal shaft 7*b* and an electroconductive elastic layer 7*a* constituting the circumference of the roller.

A usual material may be used for the intermediate transfer member and the transfer roller to be used in the invention. In the invention, the voltage to be applied to the transfer roller can be reduced by setting the intrinsic volume resistively of the elastic layer of the transfer roller so as to be lower than that of the elastic layer of the intermediate transfer member. As a result of that, the toner image can be suitably formed on the image forming support and the winding of the image forming support around the intermediate transfer member can be prevented. It is preferable that the intrinsic volume resistively of the elastic layer of the intermediate transfer member is 10 times or more of that of the elastic layer of the transfer roller.

The hardness of the intermediate transfer member and the transfer roller can be defined according to JIS K-6301. The intermediate member to be used in the invention is preferably constituted by a elastic layer having a hardness of from 10 to 40°, and the hardness of the elastic layer of the transfer roller is preferably from 41 to 80°, higher than that of the intermediate transfer member, for preventing the winding of the image forming support 6 around the intermediate transfer member. When the relation of the hardness of the intermediate transfer member and that of the transfer roller is reversed, a concave is formed on the transfer roller and the winding of the image forming support around the intermediate transfer member is tend to be occurred.

The transfer roller is rotated at a circumference speed the same as or different from that of the intermediate transfer member 5. The image forming support 6 is supplied between the intermediate transfer member 5 and the transfer roller 7 and a transfer bias having a polarity opposite to that of the triboelectricity of the toner image is applied from a bias applying means to the transfer roller 7, thus the toner image on the intermediate transfer member 5 is transferred onto the upper surface of the image forming support 6.

As the material of the transfer rotating member, that the same as for the charging roller can be used. As the processing conditions, a contacting pressure of from 4.9 to 490 N/m (5 to 500 g/cm) and a direct current bias of from ±0.2 to ±10 kV are preferable.

The electroconductive elastic layer 7*a* of the transfer roller 7 is made from an elastic substance such as polyurethane and a ternary polymer of ethylene-propylene-diene (EPDM), in which an electroconductive substance such as carbon is dispersed, having a volume electroresistivity of approximately from $10^6$ to $10^{10}$ Ω cm. A bias voltage is applied to the central metal shaft 7*b* from the constant voltage power source. As the bias condition, a voltage from ±0.2 to ±10 kV is preferable.

Thereafter, the image forming support 6 is introduced into a fixing device 11 basically constituted by a heating roller and a pressure roller contacted to the heating roller with pressure. The toner image is fixed onto the image forming support by heat and pressure by passing between the heating roller and the pressure roller. A method for fixing the image by a heater through a film may be used.

(Fixing Device)

Figure 2:
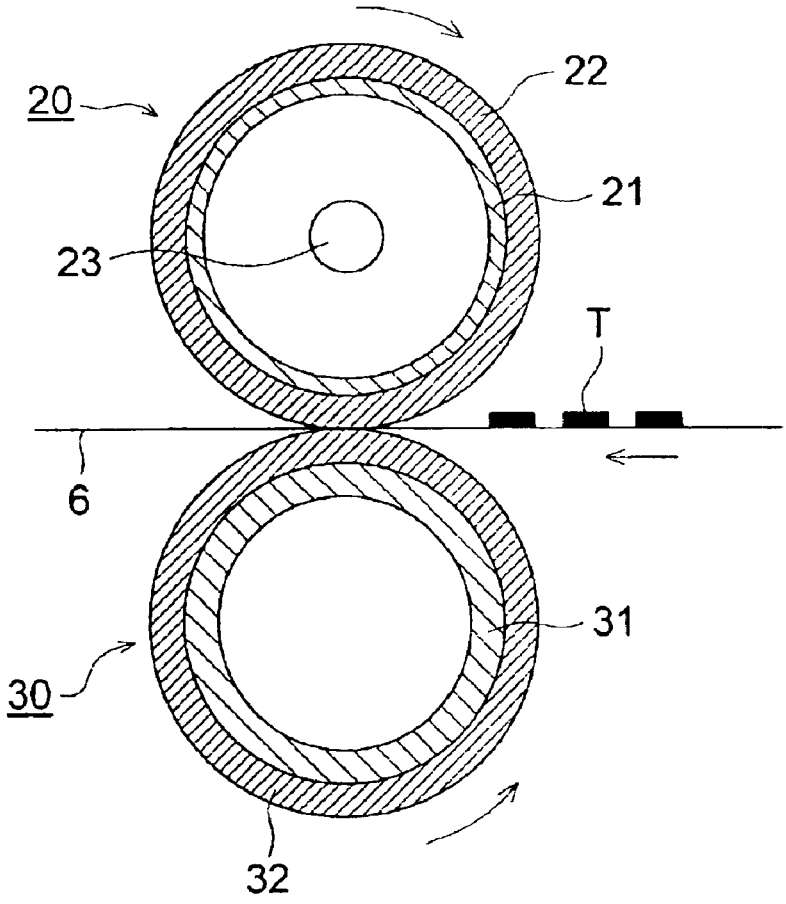
FIG. 2 is a schematic view of a fixing device which may be employed for the invention.

FIG. 2 shows a cross-section of an example of the fixing device to be used in the invention. The fixing device shown in FIG. 2 has a heating roller 20 and a pressure roller 30 contacted to the heating roller by pressure. In FIG. 2, T is the toner image formed on a recording member or an image support typically a paper sheet.

The heating roller 20 is composed of a metal shaft 21 and a cover layer 22 formed by silicone rubber or fluorine resin and includes a heating member 23 composed of a linear heater.

The metal central shaft 21 is composed of a metal or an alloy thereof and the internal diameter of the shaft is preferably from 10 to 70 mm. As the material of the shaft, for example, iron, aluminum and copper and an alloy thereof are usable.

The thickness of the metal shaft is preferably from 0.1 to 2 mm, which is decided considering the balance of the requirement of the energy saving by thinning and the strength depending on the material. For example, it is preferable that the thickness of the shaft of aluminum is controlled to 0.8 mm for obtaining strength the same as that of the shaft made from iron with a thickness of 0.57 mm.

Examples of the fluorine resin constituting the cover layer 22 include PTFE (polytetrafluoroethylene), PFA (tetrafluoroethylene-perfluoroalkoxyvinyl ether copolymer) and so on. silicone rubber such as LTV, RTV and HTV and a sponge thereof.

The thickness of the fluorine resin cover layer is preferably from 10 to 500 μm, more preferably from 20 to 400 μm.

Examples of the silicone rubber constituting the cover layer 22 include a silicone rubber such as LTV, RTV and HTV and a sponge thereof.

The Ascar hardness of the silicone rubber or rubber constituting the cover layers 22 is preferably less than 80°, more preferably less than 60°.

The thickness of the cover layer 22 is from 0.1 to 30 mm, preferably from 0.1 to 20 mm.

A halogen heater can be suitably used as the heating member 23. Plural, not only one, heating members may be used so that the heating portion can be varied according to the size or width of the paper to be passed.

The pressure roller 30 is composed of a metal shaft 31 and a cover layer of rubber 32 formed on the surface of the shaft. Urethane rubber and silicone rubber, preferably a heat resistive silicone rubber, may be used for the cover layer. A silicone rubber such as LTV, RTV and HTV and a sponge thereof are preferably used.

The Ascar hardness of the elastic material constituting the cover layers 32 is preferably less than 80°, more preferably less than 60°.

The thickness of the cover layer 32 is from 0.1 to 30 mm, preferably from 0.1 to 20 mm.

As the material of the shaft 31, for example, iron, aluminum and copper and an alloy thereof are usable The contacting load (the total load) applied between the heating roller 20 and the pressure roller 30 is usually from 40 to 350N, preferably from 50 to 300N, more preferably from 50 to 250N. The contacting load is decided considering the strength of the heating roller 20 or the thickness of the metal shaft. For instance, the load of less than 250N is preferable when the heating roller has an iron shaft having the thickness of 0.3 mm.

The nip width is preferably from 4 to 10 mm from the viewpoint of the anti-off-set property and the fixing ability. The surface pressure of the nip is preferably from 0.6 to $1.5\times10^5$ Pa.

In an example of the fixing condition of the fixing device shown in FIG. 2, the fixing temperature or the surface temperature of the heating roller 20 is from 150 to 210° C. and the line speed of fixing is from 80 to 640 mm/sec.

A cleaning means for the fixing device may be provided in the fixing device to be used in the invention according to necessity. In such the case, a cleaning method can be used, in which silicone oil is supplied to the upper roller of the fixing device by a pad, a roller or a web each immersed with the silicone oil.

As the silicone oil having a high heat resistively such as polydimethylsilicone and polydiphenylsilicone is used. One having a viscosity of from 1 to 100 Pa·s at 20° C. is preferably used since the flowing amount of the oil is made to large at the use when the viscosity of the oil is excessively low.

Specifically, the present invention exhibits marked effects for a system in which none or a definite amount of silicone oil is used. Therefore, it is preferable to provide not more than 2 mg/A4 size sheet in case the oil is employed.

An amount of the silicone oil adhered to an image forming sheet is reduced by suppressing not more than 2 mg/A4 size sheet, and as the result, it does not hinder to write the sheet by oily pen such as ball pen.

Further deterioration of off-set resistance due to denature of silicone oil according to time lapsing, contamination of optical system or charging electrodes by silicone oil can be avoided.

The providing amount of silicone oil is calculated by measuring the mass difference of fixing device (Δw) before and after putting 100 sheets of A4 size sheet through rollers of the fixing device continuously (Δw/100).

EXAMPLES

The present inventing will now be detailed with reference to examples.

Preparation Example of Latex

Placed into a 5,000 ml separable flask fitted with a stirring unit, a temperature sensor, a cooling pipe, and a nitrogen gas inlet was a surface active agent solution (water based medium) prepared by dissolving 7.08 g of an anionic surface active agent (sodium dodecylbenzenesulfonate: SDS) in 2,760 g of deionized water, and the interior temperature was raised to 80° C. under a nitrogen gas flow while stirring at 230 rpm.

A monomer solution was prepared by adding 72.0 g of the compound, represented by the aforementioned formula 19) (hereinafter referred to as "Exemplified Compound (19)") to a mixed monomer solution consisting of 115.1 g of styrene, 42.0 g of n-butyl acrylate, and 10.9 g of methacrylic acid followed by being dissolved while heated to 80° C.

Said monomer solution (at 80° C.) was mixed with and dispersed into said surface active agent solution employing a mechanical type homogenizer, having a circulation channel, and a dispersion containing emulsion particles, having a uniform dispersed particle diameter, was prepared.

Subsequently, a solution prepared by dissolving 0.84 g of a polymerization initiator (potassium persulfate: KPS) in 200 g of deionized water was added to the resulting dispersion, and the resulting mixture underwent polymerization while being heated to 80° C. and stirred for 3 hours, whereby latex was prepared.

Subsequently, a solution prepared by dissolving 7.73 g of said polymerization initiator (KPS) in 240 ml of deionized water was added to the resulting latex. After 15 minutes, a monomer mixture solution consisting of 383.6 g of styrene, 140.0 g of n-butyl acrylate, 36.4 g of methacrylic acid, and 14.0 g of n-octylmercapto propionic ester was added dropwise over 120 minutes. After said dropwise addition, the resulting mixture underwent polymerization while stirring for 60 minutes, and then cooled to 40° C. Thus latex was obtained.

The resulting latex was designated as "Latex (1)".

(Production Example of Toner)

Preparation of Colored Particles 1Bk

Added to 160 ml of deionized water were 9.2 g of sodium n-dodecylsulfate which were stirred and dissolved. While stirring the resulting solution, 20 g of carbon black, REGAL 33OR (produced by CABOT Corp.), were gradually added, and subsequently dispersed employing a stiring unit, "CLEARNIX" (produced by M TECHNIQUE Ltd.) equipped with a high speed rotating rotor. Thus a colorant particle dispersion (hereinafter referred to as "Colorant Dispersion (1)") was prepared. The colorant particle diameter of said Colorant Dispersion (1) was determined employing an electrophoresis light scattering photometer "ELS-800" (produced by OTSUKA ELECTRONICS CO., LTD.), resulting in a weight average particle diameter measurement of 112 nm.

Placed into a 5-liter four-necked flask fitted with a temperature sensor, a cooling pipe, a nitrogen gas inlet unit, and a stirring unit were 1250 g of Latex (1) obtained in Preparation Example 1, 2000 ml of deionized water, and Colorant Dispersion (1) prepared as previously described, and the resulting mixture was stirred. After adjusting the interior temperature to 30° C., 5N aqueous sodium hydroxide solution was added to the resulting solution, and the pH was adjusted to 10.0.

Subsequently, an aqueous solution prepared by dissolving 52.6 g of magnesium chloride tetrahydrate in 72 ml of deionized water was added at 30° C. over 10 minutes. After setting the resulting mixture aside for 3 minutes, it was heated so that the temperature was increased to 90° C. for 6 minutes (at a temperature increase rate of 12° C./minute). While maintaining the resulting state, the diameter of coalesced particles was measured employing a COULTER COUNTER TA II. When the volume average particle diameter reached 4.3 μm, the growth of particles was terminated by the addition of an aqueous solution prepared by dissolving 115 g of sodium chloride in 700 ml of deionized water, and further fusion was continually carried out at a liquid media temperature of 85 ±2° C. for 8 hours, while being heated and stirred.

Thereafter, the temperature was decreased to 30° C. at a rate of 6° C./minute. Subsequently, the pH was adjusted to 2.0, and stirring was terminated. The resulting coalesced particles were collected through filtration, and repeatedly washed with deionized water. Washed particles were then dried by 40° C. air, and thus colored particles were obtained. The colored particles obtained as previously described were designated as "Colored Particles 1Bk".

Preparation of Colored Particles 1Y

Colored particles 1Y were obtained in the same manner as Preparation of Colored Particle 1Bk, except that carbon black was replaced with the same amount of C.I. Pigment Yellow 185. The colored particles obtained as above were designated as "Colored Particles 1Y".

Preparation of Colored Particles 1M

Colored particles 1M were obtained in the same manner as Preparation of Colored Particle 1Bk, except that carbon black was replaced with the same amount of C.I. Pigment Red 122. The colored particles obtained as above were designated as "Colored Particles 1M".

Preparation of Colored Particles 1C

Colored particles 1C were obtained in the same manner as Preparation of Colored Particle 1Bk, except that carbon black was replaced with the same amount of C.I. Pigment Blue 15:3. The colored particles obtained as above were designated as "Colored Particles 1C".

Preparation of Colored Particles 2Bk to 11Bk, 2Y to 11Y, 2M to 11M, and 2C to 11C Colored particles 2Bk to 11Bk, 2Y to 11Y, 2M to 11M, and 2C to 11C were prepared in the same manner as Preparation of Colored Particles 1Bk, 1Y, 1M and 1C except that the salting out/fusing condition in the preparation method was varied as shown in the Tables 1 (1) to 1 (4).

TABLE 1 (1)

| Colored Particles No. | Added Amount of Magnesium Chloride (in g) | Temperature Elevation Rate (in ° C./minute) | Salting-Out/Fusion Composition Temperature | Salting-Out/Fusion Holding Time (in hour) | Particle diameter at growth stop (in μm) |
|---|---|---|---|---|---|
| Colored Particles 1Bk | 52.6 | 12 | 85 ± 2° C. | 8 | 4.3 |
| Colored Particles 1Y | 52.6 | 12 | 85 ± 2° C. | 8 | 4.4 |
| Colored Particles 1M | 52.6 | 12 | 85 ± 2° C. | 8 | 4.3 |
| Colored Particles 1C | 52.6 | 12 | 85 ± 2° C. | 8 | 4.2 |
| Colored Particles 2Bk | 52.6 | 20 | 90 ± 2° C. | 6 | 4.3 |
| Colored Particles 2Y | 526 | 20 | 90 ± 2° C. | 6 | 4.3 |
| Colored Particles 2M | 526 | 20 | 90 ± 2° C. | 6 | 4.5 |
| Colored Particles 2C | 52.6 | 20 | 90 ± 2° C. | 6 | 4.4 |
| Colored Particles 3Bk | 52.6 | 5 | 90 ± 2° C. | 6 | 4.1 |
| Colored Particles 3Y | 52.6 | 5 | 90 ± 2° C. | 6 | 4.3 |
| Colored Particles 3M | 52.6 | 5 | 90 ± 2° C. | 6 | 4.2 |
| Colored Particles 3C | 52.6 | 5 | 90 ± 2° C. | 6 | 4.4 |

TABLE 1 (2)

| Colored Particles No. | Added Amount of Magnesium Chloride (in g) | Temperature Elevation Rate (in ° C./minute) | Salting-Out/Fusion Composition Temperature | Salting-Out/Fusion Holding Time (in hour) | Particle diameter at growth stop (in μm) |
|---|---|---|---|---|---|
| Colored Particles 4Bk | 26.3 | 12 | 85 ± 2° C. | 8 | 4.3 |
| Colored Particles 4Y | 26.3 | 12 | 85 ± 2° C. | 8 | 4.3 |
| Colored Particles 4M | 26.3 | 12 | 85 ± 2° C. | 8 | 4.2 |
| Colored Particles 4C | 26.3 | 12 | 85 ± 2° C. | 8 | 4.3 |
| Colored Particles 5Bk | 78.9 | 12 | 85 ± 2° C. | 8 | 4.3 |
| Colored Particles 5Y | 78.9 | 12 | 85 ± 2° C. | 8 | 4.2 |
| Colored Particles 5M | 78.9 | 12 | 85 ± 2° C. | 8 | 4.3 |
| Colored Particles 5C | 78.9 | 12 | 85 ± 2° C. | 8 | 4.1 |
| Colored Particles 6Bk | 52.6 | 12 | 85 ± 2° C. | 8 | 3.5 |
| Colored Particles 6Y | 52.6 | 12 | 85 ± 2° C. | 8 | 3.2 |
| Colored Particles 6M | 52.6 | 12 | 85 ± 2° C. | 8 | 3.4 |
| Colored Particles 6C | 52.6 | 12 | 85 ± 2° C. | 8 | 3.5 |

TABLE 1 (3)

| Colored Particles No. | Added Amount of Magnesium Chloride (in g) | Temperature Elevation Rate (in ° C./minute) | Salting-Out/Fusion Composition Temperature | Salting-Out/Fusion Holding Time (in hour) | Particle diameter at growth stop (in μm) |
|---|---|---|---|---|---|
| Colored Particles 7Bk | 26.3 | 12 | 85 ± 2° C. | 8 | 3.4 |

TABLE 1 (3)-continued

| Colored Particles No. | Added Amount of Magnesium Chloride (in g) | Temperature Elevation Rate (in ° C./minute) | Salting-Out/Fusion Composition Temperature | Salting-Out/Fusion Holding Time (in hour) | Particle diameter at growth stop (in μm) |
|---|---|---|---|---|---|
| Colored Particles 7Y | 26.3 | 12 | 85 ± 2° C. | 8 | 3.4 |
| Colored Particles 7M | 26.3 | 12 | 85 ± 2° C. | 8 | 3.3 |
| Colored Particles 7C | 26.3 | 12 | 85 ± 2° C. | 8 | 3.4 |
| Colored Particles 8Bk | 78.9 | 12 | 85 ± 2° C. | 8 | 3.2 |
| Colored Particles 8Y | 78.9 | 12 | 85 ± 2° C. | 8 | 3.4 |
| Colored Particles 8M | 78.9 | 12 | 85 ± 2° C. | 8 | 3.5 |
| Colored Particles 8C | 78.9 | 12 | 85 ± 2° C. | 8 | 3.4 |
| Colored Particles 9Bk | 52.6 | 12 | 85 ± 2° C. | 8 | 5.6 |
| Colored Particles 9Y | 52.6 | 12 | 85 ± 2° C. | 8 | 5.5 |
| Colored Particles 9M | 52.6 | 12 | 85 ± 2° C. | 8 | 5.4 |
| Colored Particles 9C | 52.6 | 12 | 85 ± 2° C. | 8 | 5.6 |

TABLE 1 (4)

| Colored Particles No. | Added Amount of Magnesium Chloride (in g) | Temperature Elevation Rate (in ° C./minute) | Salting-Out/Fusion Composition Temperature | Salting-Out/Fusion Holding Time (in hour) | Particle diameter at growth stop |
|---|---|---|---|---|---|
| Colored Particles 10Bk | 52.6 | 12 | 85 ± 2° C. | 8 | 6.8 |
| Colored Particles 10Y | 52.6 | 12 | 85 ± 2° C. | 8 | 6.9 |
| Colored Particles 10M | 52.6 | 12 | 85 ± 2° C. | 8 | 6.8 |
| Colored Particles 10C | 52.6 | 12 | 85 ± 2° C. | 8 | 6.7 |
| Colored Particles 11Bk | 52.6 | 12 | 85 ± 2° C. | 6 | 8.9 |
| Colored Particles 11Y | 52.6 | 12 | 85 ± 2° C. | 6 | 8.8 |
| Colored Particles 11M | 52.6 | 12 | 85 ± 2° C. | 8 | 8.6 |
| Colored Particles 11C | 52.6 | 12 | 85 ± 2° C. | 8 | 8.8 |

One weight percent of hydrophobic silica (having a number average primary particle diameter of 12 nm and a degree of hydrophobicity of 68) and hydrophobic titanium oxide (having a number average primary particle diameter of 20 nm and a degree of hydrophobicity of 63) were added to each of the resultant Colored Particles 1Bk through 11Bk, and each of said resultant mixtures was mixed employing a HENSCHEL mixer, whereby Toners 1Bk through 11Bk, were obtained. Physical properties such as the shape and diameter of each toner were shown in Tables 2 (1) to 2 (4). The two-component developers 1Bk was obtained by blending corresponding toners 1Bk with silicon carrier.

Toners 1Y through 11Y, 1M through 11M, and 1C through 11C, were obtained in the same way except that the colored particles 1Bk through 11Bk were replaced with the colored particles 1Y through 11Y, 1M through 11M, and 1C through 11C, respectively. Physical properties such as the shape and diameter of each toner were also shown in Tables 2(1) to 2(4). The two-component developers 1Y, 1M and 1C were obtained by blending corresponding toners 1Y, 1M and 1C with silicon carrier.

Physical properties such as the shape and diameter of each toner comprising usually additives were substantially the same as physical property data of the colored particles.

TABLE 2 (1)

| Colored Particles No. | Dv50 in μm (1*) | Dp50 in μm (2*) | Dv50/Dp50 | Dv75 in μm (3*) | Dp75 in μm (4*) | Dv75/Dp75 | Proportion of particles (5*) |
|---|---|---|---|---|---|---|---|
| Colored Particles | 4.6 | 4.3 | 1.07 | 4.1 | 3.8 | 1.08 | 7.8 |
| Colored Particles | 4.7 | 4.3 | 1.09 | 4.1 | 3.7 | 1.11 | 7.6 |
| Colored Particles | 4.6 | 4.4 | 1.07 | 4.2 | 3.7 | 1.14 | 7.9 |
| Colored Particles | 4.5 | 4.3 | 1.07 | 4.1 | 3.7 | 1.11 | 7.8 |
| Colored Particles | 4.8 | 4.5 | 1.07 | 4.2 | 3.7 | 1.14 | 5.5 |
| Colored Particles | 4.9 | 4.5 | 1.07 | 4.1 | 3.6 | 1.14 | 5.3 |
| Colored Particles | 4.9 | 4.5 | 1.07 | 4.2 | 3.7 | 1.14 | 5.2 |
| Colored Particles | 4.8 | 4.5 | 1.07 | 4.2 | 3.7 | 1.14 | 5.5 |
| Colored Particles | 4.4 | 4.0 | 1.10 | 4.0 | 3.4 | 1.18 | 8.2 |
| Colored Particles | 4.6 | 4.1 | 1.12 | 4.1 | 3.5 | 1.17 | 8.1 |
| Colored Particles | 4.7 | 4.1 | 1.08 | 4.0 | 3.4 | 1.18 | 8.2 |
| Colored Particles | 4.7 | 4.1 | 1.10 | 4.1 | 3.5 | 1.17 | 8.3 |

(1*) Dv50: 50 percent number particle diameter
(2*) Dp50: 50 percent volume particle diameter
(3*) Dv75: 75 percent number particle diameter
(4*) Dp75: 75 percent volume particle diameter
(5*) Proportion of toner particles: Proportion of toner particles having a diameter of at most 0.7 × (Dp50) in number percent.

TABLE 2 (2)

| Colored Particles No. | Dv50 in μm (1*) | Dp50 in μm (2*) | Dv50/Dp50 | Dv75 in μm (3*) | Dp75 in μm (4*) | Dv75/Dp75 | Proportion of particles (5*) |
|---|---|---|---|---|---|---|---|
| Colored Particles 4Bk | 4.6 | 3.7 | 1.24 | 4.0 | 3.1 | 1.29 | 13.6 |
| Colored Particles 4Y | 4.6 | 3.7 | 1.24 | 4.0 | 3.0 | 1.33 | 13.9 |
| Colored particles 4M | 4.5 | 3.7 | 1.22 | 4.1 | 3.1 | 1.32 | 14.5 |
| Colored Particles 4C | 4.6 | 3.7 | 1.24 | 4.1 | 3.0 | 1.37 | 13.3 |
| Colored Particles 5Bk | 4.7 | 4.3 | 1.09 | 4.1 | 3.6 | 1.14 | 6.3 |
| Colored Particles 5Y | 4.7 | 4.2 | 1.12 | 4.0 | 3.5 | 1.14 | 6.2 |
| Colored Particles 5M | 4.5 | 4.3 | 1.09 | 4.1 | 3.6 | 1.14 | 6.3 |
| Colored Particles 5C | 4.5 | 4.0 | 1.13 | 4.1 | 3.6 | 1.14 | 6.3 |
| Colored Particles 6Bk | 3.5 | 3.1 | 1.13 | 3.1 | 2.8 | 1.11 | 6.8 |
| Colored Particles 6Y | 3.6 | 3.3 | 1.09 | 3.1 | 2.7 | 1.15 | 6.9 |
| Colored Particles 6M | 3.8 | 3.5 | 1.09 | 3.3 | 2.8 | 1.18 | 6.8 |
| Colored Particles 6C | 3.9 | 3.5 | 1.11 | 3.3 | 2.8 | 1.18 | 6.8 |

TABLE 2 (3)

| Colored Particles No. | Dv50 in μm (1*) | Dp50 in μm (2*) | Dv50/Dp50 | Dv75 in μm (3*) | Dp75 in μm (4*) | Dv75/Dp75 | Proportion of particles (5*) |
|---|---|---|---|---|---|---|---|
| Colored Particles 7Bk | 3.8 | 3.0 | 1.27 | 3.3 | 2.3 | 1.43 | 14.6 |
| Colored Particles 7Y | 3.6 | 2.8 | 1.29 | 3.2 | 2.2 | 1.45 | 14.0 |
| Colored | 3.8 | 3.0 | 1.27 | 3.3 | 2.4 | 1.38 | 14.6 |

TABLE 2 (3)-continued

| Colored Particles No. | Dv50 in μm (1*) | Dp50 in μm (2*) | Dv50/Dp50 | Dv75 in μm (3*) | Dp75 in μm (4*) | Dv75/Dp75 | Proportion of particles (5*) |
|---|---|---|---|---|---|---|---|
| Particles 7M | | | | | | | |
| Colored Particles 7C | 3.9 | 3.0 | 1.30 | 3.2 | 2.4 | 1.33 | 14.5 |
| Colored Particles 8Bk | 3.6 | 3.3 | 1.09 | 3.1 | 2.8 | 1.11 | 6.3 |
| Colored Particles 8Y | 3.8 | 3.5 | 1.09 | 3.1 | 2.8 | 1.11 | 6.3 |
| Colored Particles 8M | 3.9 | 3.7 | 1.05 | 3.3 | 2.8 | 1.18 | 6.5 |
| Colored Particles 8C | 3.9 | 3.5 | 1.11 | 3.3 | 2.8 | 1.18 | 6.3 |
| Colored Particles 9Bk | 5.8 | 5.3 | 1.09 | 5.1 | 4.5 | 1.13 | 8.4 |
| Colored Particles 9Y | 5.7 | 5.4 | 1.06 | 5.2 | 4.5 | 1.16 | 8.5 |
| Colored Particles 9M | 5.6 | 5.3 | 1.06 | 5.1 | 4.5 | 1.13 | 8.9 |
| Colored Particles 9C | 5.9 | 5.5 | 1.07 | 5.3 | 4.7 | 1.13 | 8.5 |

TABLE 2 (4)

| Colored Particles No. | Dv50 in μm (1*) | Dp50 in μm (2*) | Dv50/Dp50 | Dv75 in μm (3*) | Dp75 in μm (4*) | Dv75/Dp75 | Proportion of particles (5*) |
|---|---|---|---|---|---|---|---|
| Colored Particles 10Bk | 7.0 | 5.9 | 1.20 | 6.3 | 4.9 | 1.29 | 16.9 |
| Colored Particles 10Y | 7.3 | 6.0 | 1.22 | 6.5 | 5.0 | 1.30 | 16.0 |
| Colored Particles 10M | 7.2 | 5.7 | 1.26 | 6.3 | 4.9 | 1.29 | 16.3 |
| Colored Particles 10C | 7.0 | 5.5 | 1.27 | 6.2 | 4.7 | 1.32 | 16.7 |
| Colored Particles 11Bk | 9.3 | 8.8 | 1.06 | 7.9 | 6.9 | 1.14 | 6.3 |
| Colored Particles 11Y | 9.2 | 8.6 | 1.07 | 7.6 | 6.6 | 1.15 | 6.3 |
| Colored Particles 11M | 9.0 | 8.5 | 1.06 | 7.2 | 6.5 | 1.11 | 6.6 |
| Colored Particles 11C | 9.3 | 8.7 | 1.07 | 7.3 | 6.5 | 1.12 | 6.7 |

The toner image was formed by employing obtained toners installed in a color printer having an intermediate transfer member and a thermal roller fixing device shown by FIG. 1. Each toner image formed on the surface of the photoreceptor was transferred to the intermediate transfer member 5 successively superposing on the previous toner image. The full color image formed on the intermediate transfer member was transferred at one time to the recording member 6. The remaining toner on the photoreceptor was cleaned by a blade cleaning device.

Developing Condition

Photoreceptor: Multi-layer organic photoreceptor

DC bias: 500 volts

Dsc (distance between the photoreceptor and developer sleeve): 600 μm

Developer layer thickness restriction: Magnetic H-Cut system

Thickness of developer layer: 700 μm

Diameter of developer sleeve: 40 mm

Evaluation was carried out as follows. Employing a full color original document having a pixel ratio of 25 percent, 10,000 sheets were printed at high temperature and high humidity of 30° C./80 percent relative humidity. The difference in chroma between the first print and the 1,000th print was evaluated as the color difference.

The secondary colors (red, blue, and green) of the solid image portion in each of images formed on the first sheet and 20,000th sheet were measured by a MACBETH COLOR EYE 7000, and the color difference was calculated employing a CMC (2:1) color difference formula.

When the color difference obtained by the CMC (2:1) color difference formula was not more than 5, the variation of hue of the formed images was judged to be within the tolerance range. Half tone image having a pixel ratio of 5 percent was observed by eyes view of 10 persons to evaluate the unevenness of half tone image. Rank A or B is practically acceptable.

Criteria

A: Uniform half tone image without unevenness is observed.

B: Slight unevenness is observed.

C: Clear some belt like unevenness is observed.

The result is summarized in Table 3.

TABLE 3

| Sample No. | Combination Of Developers | Maximum difference of average diameter in μm Dv50 | Dv75 | Color Difference | Half tone Unevenness |
|---|---|---|---|---|---|
| 1 | 1Bk/1Y/1M/1C | 0.2 | 0.1 | 2 | A |
| 2 | 2Bk/2Y/2M/2C | 0.1 | 0.1 | 2 | A |
| 3 | 3Bk/3Y/3M/3C | 0.3 | 0.1 | 3 | A |
| 4 | 5Bk/5Y/5M/5C | 0.2 | 0.1 | 2 | A |
| 5 | 6Bk/6Y/6M/6C | 0.4 | 0.2 | 2 | A |
| 6 | 8Bk/8Y/8M/8C | 0.3 | 0.2 | 2 | A |
| 7 | 9Bk/9Y/9M/9C | 0.3 | 0.2 | 2 | A |
| 8 | 11Bk/11Y/11M/11C | 0.3 | 0.7 | 3 | B |
| Comp.1 | 4Bk/4Y/4M/4C | 0.1 | 0.1 | 9 | B |
| Comp.2 | 7Bk/7Y/7M/7C | 0.3 | 0.2 | 8 | B |
| Comp.3 | 10Bk/10Y/10M/10C | 0.3 | 0.3 | 9 | B |
| Comp.4 | 4Bk/4Y/10M/10C | 2.8 | 3.5 | 10 | C |

Maximum difference of average diameter difference of average diameter is the maximum difference of average diameter of each colored toner among the toner group, for example, 1Bk, 1Y, 1M and 1C, in the Table 3.

The samples 1 through 8 having Dv/Dp of 1.00 to 1.15, Dv75/Dp75 of 1.0 to 1.20, and the number of toner particles having a diameter 0.7×(Dp50) being less than 10 number percent show good result such as smaller color difference and image unevenness. The comparative samples 1 through 4 are inferior to the inventive samples in such evaluation.

What is claimed is:

1. An image forming method comprising the steps of:

forming a latent image on a latent image bearing body, developing the latent image employing a developer comprising toner, first transferring a toner image formed onto the latent image bearing body onto an intermediate transfer body, second transferring the toner image formed on the intermediate transfer body to an image forming support, and fixing the toner image which is transferred onto and formed on the image forming support, employing a fixing apparatus using a heating roller fixing system, wherein the toner comprises colored particles containing a resin and a colorant; ratio (Dv50Dp50), in which (Dv50) is the 50 percent volume particle diameter of the toner and (Dp50) is the 50 percent number particle diameter, is from 1.00 to 1.15; ratio (Dv75/Dp75) in which (Dv75) is the cumulative 75 percent volume particle diameter from largest particle diameter of the toner and (Dp75) is cumulative 75 percent number particle diameter, is from 1.00 to 1.20; and the content ratio of toner, having a particle diameter of at most 0.7×(Dp50) is less than or equal to 10 percent by number.

2. The image forming method of claim 1, wherein the ratio (Dv50/Dp50) is from 1.00 to 1.13.

3. The image forming method of claim 2, wherein (Dv50) is from 2 to 8 μm.

4. The image forming method of claim 1, wherein (Dv50) is from 2 to 8 μm.

5. The image forming method of claim 1, wherein (Dv50) is from 3 to 7 μm.

6. An image forming method comprising the steps of:

forming a latent image corresponding to a yellow image on a latent image bearing body, developing the latent image employing a developer comprising a yellow toner to form a yellow toner image on the latent image bearing body, transferring the yellow toner image on the latent image bearing body to an intermediate transfer body;

forming a latent image corresponding to a magenta image on the latent image bearing body, developing the latent image employing a developer comprising a magenta toner to form a magenta toner image on the latent image bearing body, transferring the magenta toner image on the latent image bearing body to the intermediate transfer body;

forming a latent image corresponding to a cyan image on the latent image bearing body, developing the latent image employing a developer comprising a cyan toner to form a cyan toner image on the latent image bearing body, transferring the cyan toner image on the latent image bearing body to the intermediate transfer body;

forming a latent image corresponding to a black image on the latent image bearing body, developing the latent image employing a developer comprising a black toner to form a black toner image on the latent image bearing body, transferring the toner image on the latent image bearing body to the intermediate transfer body;

transferring the yellow, magenta, cyan and black toner images on the intermediate transfer body to an image forming support; and fixing the toner images formed on the image forming support with a fixing apparatus using a heating roller fixing system, wherein each of the yellow, magenta, cyan, or black toner contains at least a resin and a colorant, and ratio (Dv50/Dp50) of each toner, is from 1.00 to 1.15 in which (Dv50) is the 50 percent volume particle diameter and (Dp50) is the 50 percent number particle diameter; ratio (Dv75/Dp75) is from 1.00 to 1.20 wherein (Dv75) is the cumulative 75 percent volume particle diameter from the largest particle diameter of each of the toners and (Dp75) is the cumulative 75 percent number particle diameter of the same; and in addition, the proportion of toner particles having a diameter of at most 0.7×(Dp50) is less than or equal to 10 percent by number.

7. The image forming method of claim 6, wherein difference between maximum 50 percent volume particle diameter and the minimum 50 percent volume particle diameter among the black toner, the yellow toner, the magenta toner and the cyan toner, is less than or equal to 1 μm.

8. The image forming method of claim 7, wherein difference between maximum 75 percent volume particle diameter and the minimum 75 percent volume particle diameter among the black toner, yellow toner, magenta toner and cyan toner, is less than or equal to 1 μm.

9. The image forming method of claim 8, wherein the yellow, magenta, cyan and black toner images on the intermediate transfer body are transferred to the image forming support at one time.

10. The image forming method of claim 9, further comprising cleaning the yellow, magenta, cyan and black toner remaining on the intermediate transfer body after transferring the yellow, magenta, cyan and black toner to the image forming support.

11. The image forming method of claim 10, further comprising charging the latent image bearing body by contacting a charging roller, charging blade, or electroconductive brush to the latent image bearing body.

12. The image forming method of claim 7, further comprising charging the latent image bearing body by contacting a charging roller, charging blade, or electroconductive brush to the latent image bearing body.

13. The image forming method of claim 6, wherein difference between maximum 75 percent volume particle diameter and the minimum 75 percent volume particle diameter among the black toner, the yellow toner, the magenta toner and the cyan toner, is less than or equal to 1 $\mu$m.

14. The image forming method of claim 6, wherein (Dv50) is from 2 to 8 $\mu$m.

15. The image forming method of claim 6, wherein (Dv50) is from 3 to 7 $\mu$m.

* * * * *